US009390702B2

(12) United States Patent
Mathur

(10) Patent No.: US 9,390,702 B2
(45) Date of Patent: Jul. 12, 2016

(54) ACOUSTIC METAMATERIAL ARCHITECTURED COMPOSITE LAYERS, METHODS OF MANUFACTURING THE SAME, AND METHODS FOR NOISE CONTROL USING THE SAME

(71) Applicant: Abhishek Mathur, Brooklyn, NY (US)

(72) Inventor: Abhishek Mathur, Brooklyn, NY (US)

(73) Assignee: Acoustic Metamaterials Inc., Brooklyn, NY (US)

( * ) Notice: Subject to any disclaimer, the term of this patent is extended or adjusted under 35 U.S.C. 154(b) by 0 days.

(21) Appl. No.: 14/503,832

(22) Filed: Oct. 1, 2014

(65) Prior Publication Data

US 2015/0279345 A1 Oct. 1, 2015

Related U.S. Application Data

(60) Provisional application No. 61/971,512, filed on Mar. 27, 2014.

(51) Int. Cl.
*E04B 1/86* (2006.01)
*G10K 11/162* (2006.01)

(52) U.S. Cl.
CPC ..... *G10K 11/162* (2013.01); *Y10T 29/49* (2015.01)

(58) Field of Classification Search
CPC ..... E04B 1/86
USPC ..... 181/294
See application file for complete search history.

(56) References Cited

U.S. PATENT DOCUMENTS

| | | | | |
|---|---|---|---|---|
| 2,192,516 | A * | 3/1940 | Cunnington | 428/158 |
| 4,531,609 | A * | 7/1985 | Wolf et al. | 181/290 |
| 4,709,781 | A * | 12/1987 | Scherzer | 181/290 |
| 6,609,592 | B2 * | 8/2003 | Wilson | 181/292 |
| 6,977,109 | B1 * | 12/2005 | Wood | 428/131 |
| 7,263,028 | B2 * | 8/2007 | Thomas et al. | 367/1 |
| 8,499,887 | B2 * | 8/2013 | Gleine et al. | 181/292 |
| 8,857,563 | B1 * | 10/2014 | Chang et al. | 181/286 |

FOREIGN PATENT DOCUMENTS

JP 05313669 A * 11/1993 ..... G10K 11/16

OTHER PUBLICATIONS

C. Fuller, "Sound Absorption Using Poro-Elastic Acoustic Meta Materials", Aug. 19-22, 2012, 14pgs, Vibration and Acoustics Laboratories, Virginia Tech, Blacksburg, VA.

L. Zigoneanu, "Sound Manipulation With Acoustic Metamaterials", Proceedings of the Internoise 2012/ASME NCAD meeting, Aug. 19-22, 2014, 8pgs, New York, NY.

(Continued)

*Primary Examiner* — Forrest M Phillips
(74) *Attorney, Agent, or Firm* — Harness, Dickey & Pierce, P.L.C.

(57) ABSTRACT

An acoustic metamaterial layered composite for noise control may include a plurality of micro-perforated plates alternately and periodically arranged with a plurality of absorbent layers and optional air gaps. The plurality of micro-perforated plates may be in a form of a periodically arranged stack and include perforations extending therethrough. Each of the plurality of absorbent layers is formed of a poroelastic material. The metamaterial layered composite noise control device is designed using the metamaterial acoustics transformation approach for optimized noise control.

18 Claims, 8 Drawing Sheets

(56) References Cited

OTHER PUBLICATIONS

B. Popa, "Homogeneous and Compact Acoustic Ground Cloaks", 2011, 6pgs, American Physical Society, Department of Electrical and Computer Engineering, Duke University, Durham, North Carolina 27708 , USA.

B. Pupa , "Design and Characterization of Broadband Acoustic Composite Metamateriais", 2011, 6pgs The American Physical Society, Department of Electrical and Computer Engineering, Duke University, Durham, North Carolina 27708, USA.

S. Cummer, "One Path to Acoustic Cloaking", 2007, 8pgs, New Journal of Physics 9 (2007) 45, Department of Electrical and Computer Engineering, Duke University, P 0 Box 90291, Durham, NC 27708, USA.

J.B. Pendry, "Controlling Electromagnetic Fields", 2006, 5pgs, New Journal of Physics, Science 312, 1780 (2006); DOI: 10.1126/science.1125907, Washington, DC.

* cited by examiner

ACOUSTIC METAMATERIAL ARCHITECTURED COMPOSITE LAYERS, METHODS OF MANUFACTURING THE SAME, AND METHODS FOR NOISE CONTROL USING THE SAME

CROSS-REFERENCE TO RELATED APPLICATION

The present application claims priority under 35 U.S.C. §119 (e) to U.S. Provisional Application No. 61/971,512, filed Mar. 27, 2014, the entire contents of which are hereby incorporated herein by reference.

BACKGROUND

1. Field

The present disclosure relates to acoustic materials, methods of manufacturing the same, and methods of manipulating sound waves using the same for purposes of noise control.

2. Description of Related Art

Conventional materials and methods for noise control are divided into two general categories: sound blocking and sound absorption. With regard to the first category, sound blocking involves the impedance or prevention of sound from entering or leaving a space (e.g., room). With regard to the second category, sound absorption involves the reduction of the sound bouncing around inside a space (e.g., room), thereby decreasing or eliminating echoes and reverberations within. Thus, with sound absorption, the source of the sound is in the same room with the listener (unlike the situation with sound blocking).

Conventional noise control methods rely heavily on passive "add-on" treatments, such as damping and absorptive materials. Passive control approaches are used because they are relatively inexpensive and easy to implement. However, their performance is not optimal and also limited to the mid and high frequency range. Conventional passive methods, such as adding mass, damping, or acoustic absorption, etc., not only impose a stiff weight penalty, they are also ineffective in improving the low-frequency sound transmission loss of structures.

SUMMARY

The present application relates generally to improving noise reduction and sound absorbent efficiency of architectured composite layers over a broadband frequency range. The present methodology uses acoustic metamaterial principles to design and optimize acoustic performance of a composite layered device including perforated plates and absorptive materials as metamaterial layers.

A method and process to design and make noise control layer architecture composite comprising of acoustic metamaterial layers interspersed with absorbent material layers are described herein. Acoustic metamaterial principles are used to design both the acoustic metamaterial and the interspersed acoustically absorbent layers. The method utilizes a unique acoustic metamaterial approach to achieve the desired results. Porous layers are also suitably designed by metamaterial principles.

Acoustic metamaterials are artificially fabricated materials designed to control, direct, and manipulate sound waves. Metamaterials may gain their properties from their arrangement rather than composition, using the inclusion of small periodically arranged inhomogeneities to enact effective macroscopic behavior. The architectured composite of this application can be made to take advantage of its constituent sub-wavelength properties rather than its overall material characteristics.

In an example embodiment, an acoustic metamaterial composite may include a plurality of micro-perforated plates with perforations extending therethrough, the plurality of micro-perforated plates being in a form of a periodically arranged stack; and a plurality of absorbent layers alternately arranged with the plurality of micro-perforated plates, each of the plurality of absorbent layers being a poroelastic material.

In another example embodiment, a method of manufacturing an acoustic metamaterial composite may include forming a plurality of micro-perforated plates and a plurality of absorbent layers alternately arranged with the plurality of micro-perforated plates, a percentage of open area (POA) of each of the plurality of micro-perforated plates and a thickness of each of the plurality of absorbent layers determined using at least the following Equations 1 and 2.

$$\bar{\rho}^{\gamma} = \frac{\det(J)(J^{-1})^{T}}{J}\bar{\rho}^{\nu} \qquad \text{Equation 1}$$

$$\bar{\kappa}^{\gamma} = \det(J)\bar{\kappa}^{\nu} \qquad \text{Equation 2}$$

In Equations 1 and 2, $\rho^{-r}$ is a fluid density in a real domain, $\rho^{-\nu}$ is a fluid density in a virtual domain, $\kappa^{-r}$ is a fluid bulk modulus in a real domain, $\kappa^{-\nu}$ is a fluid bulk modulus in a virtual domain, and J is a Jacobian transformation.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
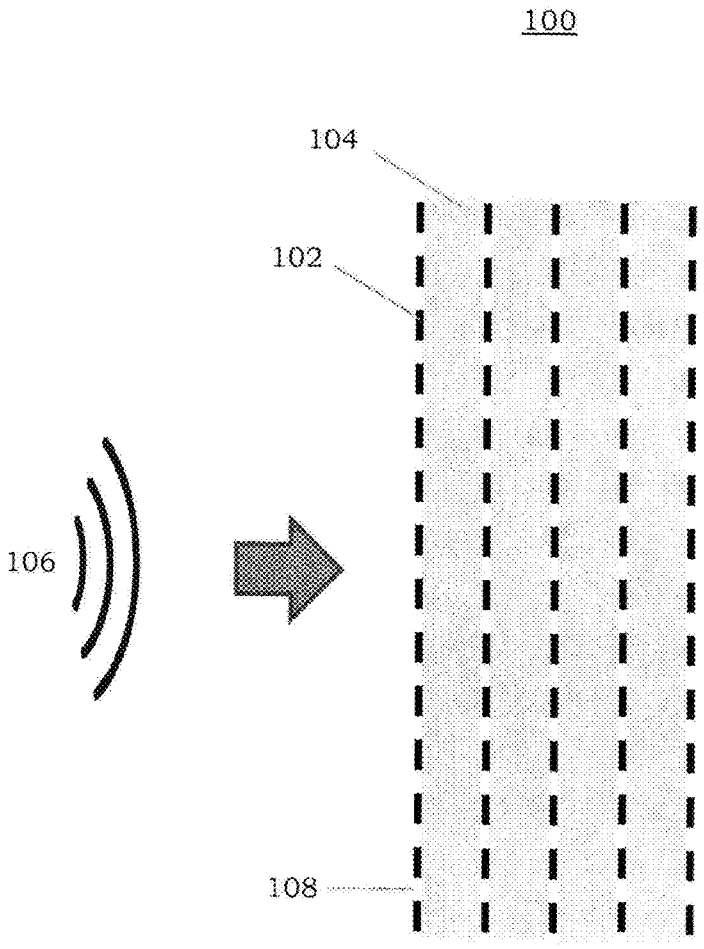
FIG. 1 is a schematic view of an acoustic metamaterial composite according to an example embodiment.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

In solids, liquids, and gases, sound waves travel in the form of a vibration or wave of molecules produced when an object moves or vibrates through a medium from one location to another. A wave can be described as a disturbance that travels through a medium, transporting energy from one location to another location. The medium is simply the material through which the disturbance is moving. When an object moves or vibrates, the molecules around the object also vibrate, thereby producing sound. Sound can travel through any medium except vacuum.

Sound-absorbing materials, such as foams, fiberglass, absorbent panels, carpeting on the floor, and drapes or special absorbent wall coverings, are commonly used in various industries to reduce noise for which the sound waves are reflected, absorbed, and transmitted when they hit a hard surface. A commonly used term to define and evaluate sound absorption is the sound absorption coefficient. The sound absorption coefficient is a measure of the proportion of the sound striking a surface, which is absorbed by that surface, and is usually given for a particular frequency. Thus, a surface which would absorb 100% of the incident sound would have a sound absorption coefficient of 1.00, while a surface which absorbs 35% of the sound, and reflects 65% of it, would have a sound absorption coefficient of 0.35. Materials which are dense and have smooth surfaces, such as glass, have relatively small absorption coefficients. On the other hand, porous-type materials, such as glass wool or fiberglass blankets, that contain networks of interconnected cavities tend to scatter the sound energy and tend to trap it so as to have higher absorption coefficients. In particular, there is greater interaction at the surface of such porous-type materials and more opportunities during these scattering reflections for the sound wave to lose energy to the material. Consequently, these materials possess relatively larger sound absorption coefficients in the mid to high frequency range, i.e. above 500 Hz. Another commonly used term is sound transmission loss. The sound transmission loss is the reduction in incident power of the acoustic wave as it transmits through the material and is expressed in decibels (dB).

One of the primary requirements of many noise insulating materials for industrial applications, such as that required for aerospace and automobile industries, is that they should have a relatively low density and, at the same time, have high noise insulation. For example, the lower weight allows for more cargo and passengers to be carried and also helps to reduce fuel consumption, which in turn provides airlines with a more efficient and more competitive aerospace product.

Traditionally, fiberglass blankets and porous materials, such as melamine foam, polyurethane foam layers, have been used in various industries for sound absorption and noise reduction. However, the fiberglass blankets or other porous layers may not provide sufficient and required acoustic absorption and noise reduction at lower frequencies. Lower frequencies may be, for example, frequencies that are less than about 500 Hz. In order to improve sound absorption at lower frequencies and to reduce weight at mid to higher frequencies to achieve the same performance, several conventional designs have been pursued. However, these solutions may be less efficient, more costly, and add more weight than desired when redesigning noise reduction systems to take into account the increases that may be caused by composite structures. Therefore, it would be desirable to have a method that takes into account at least some of the issues discussed above, as well as other possible issues.

All types of porous foam and fiberglass blankets used as absorptive materials in sound insulation depend on their internal tortuous structure to absorb sound. A micro-perforated plate or panel (MPP), on the other hand, uses the acoustic resistance of small holes to absorb the energy of sound waves. A MPP is usually tuned to a given frequency (Hz, cycle/sec) using given parameters of holes and a hard wall backing. A multilayer design with glass wool layers and micro-perforated absorber layers that are interspersed in between may also further improve the acoustic absorption capacity of the composite elements. These designs are based on optimizing acoustic absorption properties and utilizing changes in impedance.

This application addresses an innovative method using an acoustic metamaterial approach to significantly improve the broadband acoustic transmission loss and/or absorption characteristics of structures without adding significant weight. Acoustic metamaterials can be generally divided into two main areas. Resonant materials usually consist of a matrix material in which is embedded periodic arrangements of inhomogeneities such as rigid spheres or cylinders with a spacing of less than a wavelength. The embedded structures cause wave scattering and resonant behavior which creates stop band behavior and refraction effects. Also, non-resonant acoustic metamaterials may be designed to control the propagation of acoustic waves through fluids and materials. Most of the work with acoustic metamaterials has been directed mainly towards cloaking, optical lens, or SAWs applications, and these materials are suitable for the above discussed aircraft applications. However, there has been very limited work on such acoustic metamaterials that diffract and refract sound waves and allow control over wave propagation for noise control area.

Common sound absorptive materials are open-cell foam or fiberglass. Sound absorption is an energy conversion process. The kinetic energy of the sound (air) is converted to heat energy when the sound strikes the cell walls. However, open-cell foams are relatively poor sound absorbers at low frequencies and require a thickness of at least one-quarter of a wavelength to adequately absorb sound. A perforated facing may be mounted on top of the porous/foam material and, depending on the thickness, hole size, and spacing, can partially act as a panel absorber to increase absorption at certain frequencies. This application utilizes innovative methods and arrangements to achieve maximum transmission loss of sound wave energy within the metamaterial architecture core and along the width of the core of the composite. A combination of metamaterial designed perforated face sheet and foam core will give much better sound insulation than that achieved with one put together with random perforations.

Acoustic metamaterials theory may be used as a design tool in the form of Transformation Acoustics (TA) based on a solid mathematical background to guide and manipulate sound waves. Transformation Acoustics (TA) is based on the invariance of the acoustic wave equation under coordinate transformation. Coordinate transformations and TA provide a powerful technique to design devices capable of remarkable control over wave propagation. The fluid densities and bulk modulii in real and virtual domains may be obtained using the following TA equations:

Transformation Acoustics Equations:

$$\bar{\rho}^r = \frac{\det(J)(J^{-1})^T}{J}\bar{\rho}^v$$

$$\bar{\kappa}^r = \det(J)\bar{\kappa}^v$$

In the above TA equations, $\bar{\rho}^r$ is a fluid density in a real domain, $\bar{\rho}^v$ is a fluid density in a virtual domain, $\bar{\kappa}^r$ is a fluid bulk modulus in a real domain, $\bar{\kappa}^v$ is a fluid bulk modulus in a virtual domain, and J is the Jacobian transformation.

Using the TA equations, acoustic metamaterial elements may be designed and created that can produce negative acoustic density and negative bulk density. Such negative acoustic properties, which can allow waves to bend and refract in a controllable manner, are not found in conventional materials and designs or in nature. The general procedure is to design a desired wave field in the transformed domain and then transform the system properties back to the physical domain in order to determine the desired acoustic metamaterial (AMM) structure. Generally this includes of layers of varying impedance arranged in a periodic manner. The resonant behavior of the periodicity and the varying impedance model the required negative density and stiffness (bulk modulus of the gas). Several applications of the transformation acoustics have been considered and the most striking has been the possibility of acoustic cloaking that can make a domain undetectable (inaudible) by acoustic waves. The concept of transformation acoustics (TA) may be used to realize arbitrary bending of acoustic waves with acoustic metamaterials that generally have anisotropic mass density. Several design methodologies are possible to obtain this anisotropy and to control the effective material parameters in the desired way. The above concept may be used to build a 2D acoustic cloak. Such a device includes an arrangement of periodically spaced perforated plates, and thus its behavior relies on the periodic nature of the plates causing stop band behavior. In addition, the diffraction through the perforations causes wave interference behavior. The resonant metamaterial approach may be implemented with a periodic arrangement of spheres embedded in a poroelastic matrix to design a poroelastic absorbent metamaterial. 3-dimensional AMM acoustical cloaks are also feasible. A multi-ring scatterer may be used to create a 3-dimensional cloaking device to acoustically shield a spherical object. A thin stack of artificially micro-structured metamaterial, such as perforated plates, can act as an acoustic metamaterial.

Using the Transformation Acoustics (TA) approach, the densities and bulk modulus in two dimensions on a structure can be engineered to be anisotropic. This numerical technique to design acoustic metamaterials allows the design of broadband acoustic metamaterials with material parameters to be precisely controlled. A basic and simplified design methodology is discussed below.

To obtain design parameters for a homogeneous MPP panel, a linear transformation function between virtual and real domains is first required in conjunction with the TA equations above. Since the material parameters for the metamaterial panel are given by the first partial derivatives of the transformation functions, a linear transformation function is required in order to obtain a homogeneous micro-perforate panel. One such choice suitable for the linear transformation is a triangular function. Other variations of linear transformations may also be considered. A simple triangular function between (x, y, z) and (u, v, w) coordinate systems may be as follows:

$$u = x_r$$
$$v = \frac{c}{c-a}\left(-a + \frac{a}{b}|x| + y\right),$$
$$w = w_z z,$$

where a and b are given by the geometry of the MPP and fiberglass insulation package, and c is a parameter that determines the metamaterial panel dimensions. It is to be noted that the expression of $\upsilon$ is not linear inside the whole transformation domain; however, it is linear inside each one of the $x<0$ and $x>0$ domains. This translates into the same material parameters in each half of the metamaterial panel but different directions of the principal axis, defined as the directions along which the material parameter tensors are diagonal. The constant $w_z$ represents a degree of freedom that allows for a tradeoff in performance for fabrication simplicity.

The material parameters of the metamaterial MPP panel, i.e., mass density pseuclotensor and bulk modulus, are then given by:

$$\rho=\det(J)\,(J^{-1})^T J^{-1}\rho_0,\ B=\det(J)B_0$$

where $\rho_0$ and $B_0$ are the parameters of air, and J is the Jacobian transformation:

$$J = \frac{\partial(x, y, z)}{\partial(u, v, z)} = \left[\frac{\partial(u, v, z)^{-1}}{\partial(x, y, z)}\right].$$

The material parameters $\rho_{11}{}^r$, $\rho_{22}{}^r$, and $\kappa^r$ in the real coordinate axis (x, y, z) are then obtained. The angle $\theta$ between the MPP and the longitudinal axis is also determined from the coordinate transformations. For simplicity of construction, the angle $\theta$ can be 90 degrees. This will, however, affect the performance of the MPP absorber sheet metamaterial composite noise control system.

In order to keep refractive and/or reflective properties of MPP sheets to a maximum, it is important to minimize the absorption of the MPP sheets. It is therefore important to analyze acoustic absorption characteristics of bulk perforate metamaterial MPP sheets.

For the abovementioned reason, i.e., to simulate and obtain physically realizable anisotropic metamaterial systems, micro-perforated plates (MPP) are used in example embodiments of the present disclosure. The size and shape of the perforations determine the momentum in the plate produced by a wave propagating perpendicular to the plate and, therefore, can be used to control the corresponding mass density component seen by the wave. This property is used to obtain the higher density component. The diameter of holes and spacing between holes are then determined using an algorithm based on micro-perforated plate (MPP) theory to simulate the required density and bulk modulus.

On the other hand, when the wave propagates parallel to the plate, it will have a relatively small influence on it. Consequently, the wave will see a density close to that of the background ambient fluid. The compressibility of the cell, quantified by the second effective parameter, the bulk modulus, is controlled by the fractional volume occupied by the plate.

Absorptive layers in the metamaterial composite noise control system perform a similar role as micro-perforated plates (MPP) as it has been shown that a MPP designed for maximum sound absorption can be simulated by an equivalent absorptive layer. However, absorptive layers are basically designed for the role of maximum absorption of sound waves rather than reflective and/or refractive purposes as the metamaterial MPP sheets designed for this application, as explained above. Thus, absorptive layers maximize absorption of sound waves, whereas MPP sheets perform the dual role of refraction and/or reflection along with some absorption of sound waves. A periodic arrangement of MPP and absorptive layers thus forms a unique metamaterial composite noise control system.

According to an example embodiment, perforated plates are interspersed with acoustically absorbent layers, and the system is designed using acoustic metamaterial principles. At the subsystem level, the size and shape of the perforations of the perforated plates which ultimately determine the momentum in the rigid plates, produced by a wave propagating perpendicular to the plate, are designed and optimized using TA theory, and, therefore, can be used to control the corresponding mass density component seen by the wave. The thickness of acoustically absorbent layers is also optimized using metamaterial principles. A device made of perforated plates interspersed with absorptive layers shows that sound in air can be fully and effectively manipulated using realizable transformation acoustics devices. This approach can be used to design systems to control and manipulate sound waves for the purpose of enhancing sound transmission loss and/or absorption, although the required material parameters are highly anisotropic.

The prediction of negative refraction in materials exhibiting negative effective mass density and negative bulk modulus in the operating frequency range required acoustic metamaterial designs that can be fabricated. In this context, acoustic metamaterial designs may contain resonators in the form of spheres (e.g., coated spheres), lumped elements, or perforations. The size and shape of the perforations determine the momentum in the rigid plate produced by a wave propagating perpendicular to the plate, and, therefore, can be used to control the corresponding mass density component seen by the wave. The device may include perforated plates or membranes of metal and/or thermoplastic material, such as polycarbonate. The acoustically absorbent layers can be made of acoustic foam, such as melamine or fiberglass layers. However, it should be understood that other acoustically absorbent materials may also be used. The selection of materials used may be influenced by several factors, such as environment, acoustical characteristics, material properties, weight, robustness, toxicity, smoke production, fire resistance, cost, shelf life, regulations, etc.

Transmission of acoustic energy from one fluid region to another region is passively controlled or reduced by primarily two methods. In the first approach, sound energy is absorbed by materials that are designed and matched to accept sound waves and then efficiently dissipate it into heat energy. Such systems include acoustic blankets, porous material, absorbent foam, etc. In the second method, sound is reflected by means of inserting a change in acoustic impedance into the transmission path. Examples in this category include metal sheets, room walls, noise control enclosures, expansion chambers, etc. Thus, sound waves can be blocked or reflected back by a change in acoustic impedance, which need not include sound absorption as the main mechanism.

Transmission loss (TL) is the measure of the installation independent sound attenuation properties of a simple panel and can be defined in terms of transmission co-efficient, τ.

$$TL = 10\log\left(\frac{1}{\tau}\right),$$

$$\tau = \frac{\Pi_t}{\Pi_i},$$

$\Pi_l$ is the transmitted acoustic power, and $\Pi_i$ is the incident acoustic power on the panel.

Similarly, the reflection co-efficient, r, is defined as the ratio of the reflected acoustic power to the incident acoustic power.

$$r = \frac{\Pi_r}{\Pi_i}$$

The absorption co-efficient is now defined as the ratio of acoustic power that is not reflected back to the incident acoustic power or $$a=1-r.$$

Thus, the transmission loss and the absorption coefficient are two important but very different acoustic parameters. Transmission loss of a structure is a measure of loss of acoustic energy as sound waves pass through it and is measured accordingly. A simple metal sheet reflects sound energy but also allows it to pass through based on the well-known mass law. The classical mass law formula for a simple infinite panel for plane waves at normal incidence is given by:

$$\tau = \left(\frac{2\rho c}{\omega m}\right)^2,$$

$$TL = 20\log\left(\frac{\omega m}{2\rho c}\right)$$

Where m is the surface mass density of the panel and ω is the circular frequency (=2πf). The mass law states that the transmission loss (TL) of the panel is increased by about 6 dB by doubling the mass or frequency. In the above formula, structural damping is assumed negligible for the sake of simplicity.

In simple electro-mechanical analogue circuit analogy, the mass of the panel can be represented by electrical inductance, stiffness by capacitance, and mechanical damping by resistance. The panel impedance, $Z_p$, may be represented by:

$$Z_p = j\omega m + \eta + \frac{\kappa}{j\omega},$$

Where η is the structural damping, κ is the stiffness of the panel, and j is the imaginary operator.

The acoustic energy which is converted to vibration energy of the panel is absorbed by structural damping, which is the resistive part of the impedance, whereas (jωm and κ/jω) are inductance terms and do not absorb energy. It is well known that by increasing structural damping of the panel, transmission loss of the panel can be increased. However, adding damping to the structure is costly and involves adding weight to the structure and also reaches a saturation limit. The effects of stiffness term are also well known and show up in the form of mechanical resonances of the structure which reduce TL at resonant frequencies. It is also known that the sound transmission loss of a composite structure can be greatly but adversely influenced by the stiffness term.

For acoustically absorptive materials, the absorption of sound waves is mostly facilitated by the acoustic resistance offered by fibrous/porous materials. In the electro-acoustic analogue equivalent circuit, the acoustic resistance of a fibrous material is represented by electrical resistance, which absorbs energy. Acoustic inductance and capacitance of the material reflect sound waves and create impedance mismatch between the material and ambient medium. The acoustic elements, such as a Helmholtz resonator has all these three elements, namely acoustic capacitance in the form of a volume, acoustic inertance, and resistance offered by a pipe or neck. At the tuned frequency of a classical Helmholtz resonator, acoustic capacitance and inertance are cancelled, and energy is absorbed by acoustic resistance built in the small neck or pipe. Fibrous materials, on the other hand, offer both acoustic resistance and inductance over a wide frequency range and become absorptive only when its overall acoustic impedance matches that of the ambient medium. It may be noted that the acoustic resistive part of the impedance is quite small. There is an inherent limitation in fibrous or porous materials that acoustic resistance and inductance cannot be varied independently of each other. Any change in acoustic impedance of fibrous materials requires basic changes in chemical/structural formulation and manufacturing of such materials.

Most of the noise control methods largely depend on mechanical damping of visco-elastic materials added to the structure and acoustic absorption capabilities of fibrous materials, both of which are essentially resistive elements. Since most of the noise control treatments usually involve absorptive blankets, enhancing absorption further may not be very effective. In an example embodiment, a different acoustic resistive device is implemented using metamaterial architecture layers incorporating micro-perforates and porous layers. A micro-perforate permits tailoring of its acoustic properties by controlling its hole diameter and other parameters. The acoustic metamaterial layered device differs significantly from conventional micro-perforates, which are usually designed for providing high acoustic absorption. The layered device is markedly different from an absorptive micro-perforate device in that micro-perforates are optimized for high sound absorption, whereas in the present device, micro-perforates are used to enhance acoustic resistance of the device and not for the sound absorption to provide a high transmission loss. Also, the design methodology is based on determining parameters using metamaterial theory. Also, traditional micro-perforates are tuned to certain frequencies, as done for Helmholtz resonators, whereas the present devices are not tuned at a given frequency but work over a much wider frequency range. The present device thus offers a revolutionary method of introducing appropriately tailored acoustic resistance in the noise control package to be inserted in the path of propagation of sound energy. Due to enhanced acoustic resistance and damping, transmission loss of the structure and noise control treatment package is significantly improved. The optimum parameters for layered MPP and porous materials are determined using transformation acoustics.

The specific acoustic impedance of a micro-perforate is given by:

$$Z=R+j\omega M-jC,$$

Where R is the acoustic resistance, M is the reactance, and C is the compliance.

The acoustic resistance R (in the above equation) is given by:

$$R = \left(32\mu\rho\frac{t}{\mathrm{Pa}^2}\right)\left[\sqrt{1+\frac{x^2}{32}}+0.177x\frac{a}{t}\right],$$

Where t is the MPP panel thickness, a is the hole diameter, P is the porosity of the panel equal to the ratio of the perforated open area to the total area of the panel, and x is the kinematic viscosity of air (=10 asqrt(f)).

In a MPP where a~t, the above equation can be approximated as:

$$R \approx \left(32\mu\rho\frac{t}{\mathrm{Pa}^2}\right)$$

This means that acoustic resistance R is inversely proportional to a square of the hole diameter a, inversely proportional to the porosity P, and proportional to the thickness t of the MPP panel. Thus, reducing the perforation hole diameter a is the most effective way to increase the acoustic resistance R of the panel (which also causes the damping of the panel Helmholtz system to increases and the attenuation peak widens). Increasing the thickness t of the panel is another way to increase acoustic resistance R. However, such an approach is not as effective as reducing the perforation hole diameter a. The above equation shows that the panel's acoustical resistance R is inversely proportional to the second power of perforation hole diameter a while proportional to the first power of panel thickness t. This relationship explains why decreasing hole diameter a is more effective than increasing the panel thickness t for increasing the panel acoustic resistance R and therefore sound attenuation. The effect of panel thickness t is further dimmed due to the so called "effective mass" of the vibrating air. When the air inside an orifice (i.e. a perforated hole) vibrates, the air entering and exiting it also vibrates. This added vibrating air effectively adds mass to the air column inside the orifice and thus makes the equivalent length of the orifice longer than its geometric length. This added effective length at each end of the orifice is approximately 0.85 times the orifice diameter. For the micro-perforated panels, the perforation hole diameter a may be approximately the same as the panel thickness t. Therefore, this added length may be 1.7 times the geometric length of the orifice, i.e., the thickness of the panel. As a result, doubling the panel thickness t only increases the total effective thickness of the panel by 37%. Thus, although an increase in panel thickness t should theoretically increase the panel system resistance, its practical effect is minimal. The positive side of this phenomenon is that reducing the panel thickness t does not reduce the panel acoustic resistance R much either.

A preliminary version of a resonant acoustic metamaterial using periodic masses in a foam matrix has been constructed and tested. This material included a periodic arrangement of various masses located in either a melamine or polyimide matrix. The results show that the addition of the embedded masses leads to a significant increase in absorption coefficient and the transmission loss of the polyimide foam at low frequencies and thus support the potential of the acoustic metamaterial. The frequency at which the peak in absorption coefficient occurs changes for different types of embedded masses illustrating the design potential of acoustic metamaterials.

This application relates to non-resonant acoustic metamaterial architectured composite materials which utilize periodic arrangement of metamaterial plates and sound absorptive layers. The periodic arrangement of layers of perforated sheets and absorptive layers is designed using metamaterial principles to optimize and provide maximum sound insulation (i.e., transmission loss) over a broadband frequency range. Alternately, a similar approach may be used to enhance sound absorption characteristics of the layered metamaterial composite. For a high noise insulation package, acoustic metamaterial design of the MPP increases acoustic resistance and reflects sound waves which are absorbed in the surrounding absorbent layers. In the case of a high acoustic absorbent package, the metamaterial MPP layer attracts/focuses sound waves into the core of the treatment package rather than partially reflecting them at the interfaces of the composite blanket. The attractive combination of high sound insulation to weight renders metamaterial architecture composite layered structures very useful for cases where higher sound transmission loss is desired.

The periodic arrangement of micro-perforated plates and absorptive layers can be optimized to enhance sound transmission loss over a broadband frequency range for many industrial applications, such as aerospace, HVAC, automotive, etc. The thickness and material properties of absorptive layers and design parameters of micro-perforated plates, such as hole diameter, hole spacing etc., can be optimized using the metamaterial approach.

The number of micro-perforated plates and absorptive layers is also important in the periodic arrangement of architectured metamaterial composite layers and can be optimized to improve sound transmission loss over a broadband frequency range. In practical applications, it may be desired to design a noise control product with a minimum number of layers of MPP and absorptive layers to achieve the optimum result.

There can be periodic air gaps introduced between the architectured metamaterial composite layers including the micro-perforated plates and absorptive layers. For example, periodic air gaps may be introduced between each MPP and absorptive layer. The width of the air gap is important for transmission loss enhancement and must be included and optimized in an overall design process.

The method of mounting and supporting each MPP and absorptive layer of the architecture metamaterial composite layers can also influence the overall transmission loss of the noise control product. For instance, limp MPP layers may not provide the best results. As a result, each MPP layer may be secured (e.g., glued) to a specially designed, lightweight frame all around its edges using an appropriate adhesive to provide fixed-fixed boundary conditions all around its edges. The absorptive layers may also be supported using the same frame element.

In another variation of providing edge support to MPP layers, hooks and eyelets may be used to fasten MPP sheet edges at some points all around a frame. In a similar fashion, eyelets and screws may be used to attach MPP layers to a frame. Velcro strips may also be used for easy attachment for MPP sheets at its edges to the frame. Similarly, double-sided glue strips may be used to attach MMP layers to the frame.

The ability of a substance to conduct heat is measured by its thermal conductivity. Materials differ widely in their ability to conduct heat. Substances, which have air trapped in their structures, are relatively poor conductors. Fiberglass blankets (0.033-0.036 W/mK) or porous foams, like melamine, have a relatively low thermal conductivity in the range of 0.033-0.035 W/mK as they have pores filled with air, which has a much lower thermal conductivity (the thermal conductivity of air is about 0.025 W/mK at 15° C.). In various example embodiments, air gaps are utilized to further reduce the thermal conductivity of the treatment package (<0.03), so that the thickness of the layered blankets for thermal insulation purposes may be reduced.

Several unique architectures are disclosed herein for creating optimum perforations in the alternating arrangement of perforated plates and sound absorbing layers. This type of periodic pattern increases acoustic resistance of the layer and blocks the free propagation of sound waves within cells across the width of the core. The diameter, number, and depth of the perforations across the width are also varied.

Sound waves require an acoustically porous material for effective absorption and, therefore, are not efficiently propagated in materials such as liquids or gases. A traditional approach utilized for sandwich structures is to put a sound absorbing material sandwiched between a perforated lining and an external surface. The perforated lining usually includes a sheet with a pattern of small, evenly spaced holes that can effectively absorb sound at particular tuned frequencies. The perforated lining is mounted on top of the porous material and, depending on the thickness, hole size, and spacing, can partially act as a panel absorber to increase absorption at certain frequencies.

Sound wave energy can also be easily and effectively absorbed using absorptive materials in the path of the wave propagation. This can be viewed from the perspective that waves are basically sound waves in solids. Sound waves are easily absorbed in absorptive materials. Thus, the energy of sound waves propagating within the composite layers core can be further reduced by incorporating layers of lightweight absorptive material (such as acoustic foam).

Face sheets without holes or perforations do not allow sound wave to go through into the core of the sandwich and will be ineffective as acoustic absorbers as sound waves will be reflected from the surface of the face sheet. The sound absorption coefficient of such a sandwich (i.e., top face sheet without perforations) will be relatively low, even though the core may be acoustically absorbent. The face sheet perforations need to be in certain proportions, i.e., hole diameter, spacing between holes, and percentage of open hole area (POA) compared to face sheet area for optimum absorption. A face sheet with too many holes or overly large holes will not be of much help acoustically and will render the face sheet structurally weak. The face sheets can be constructed of any high modulus composite or metallic material. For example, composite face sheets may be constructed of glass fiber or carbon fiber and epoxy resin. The optimum hole parameters can be determined based on the material for the face sheet so as to give the optimum effect for sound absorption. The embedded MPP sheets can be constructed from relatively thin, lightweight plastics.

A numerical software based on Transformation Acoustics (TA) and metamaterial principles can be used to determine the MPP parameters and sound absorbing material system for the architecture composite system. The design parameters for perforated plates for metamaterial layers may be determined with the software, and micro-perforations may be drilled in the top face sheet. The thickness and material of the sound absorbing layers are also qualified to create an acoustically insulating sandwich. The micro-perforations in the face sheet can be more dense than those in the core. Micro-perforations present high acoustical resistance to the incident acoustic waves, thereby absorbing a relatively large portion of the incident energy. The remaining acoustic energy can enter the sound absorbing layers and can be further absorbed. Micro-perforations can be created using mechanical and/or laser tools.

The face sheets and sound absorbing layers of the composite section may be infused with 3-5% by weight of carbon nanofibers or nano-particles in various forms, such as large nanofibers, small nanofibers, and mixed nanofibers, to enhance the thermal conductivity of the composite so that more heat can radiate out of the sandwich. Nanofiber non-wovens can be integrated either directly in the matrix or as discrete fibrous layers in series with the composite sandwich face sheets. An increase of approximately three-fold in thermal conductivity can be obtained using nanofibers in the matrix. The nano-skin and nano-infused composite core provides for increased thermal and electrical conductivity for PMI structures.

Example embodiments of the present disclosure are discussed below in further detail in connection with the figures. However, it should be understood that the following embodiments are merely examples, and the present disclosure is not limited thereto. Notably, it should be understood that the features discussed in connection with one example may also be applicable to one or more other examples although not explicitly discussed.

FIG. 1 is a schematic view of an acoustic metamaterial composite according to an example embodiment. Referring to FIG. 1, the acoustic metamaterial composite 100 includes a plurality of micro-perforated plates 102 alternately arranged with a plurality of absorbent layers 104. The micro-perforated plates 102 include perforations 108 extending therethrough. The plurality of micro-perforated plates 102 may also be evenly spaced from each other so as to form a periodically arranged stack. Each of the plurality of absorbent layers 104 are formed of a poroelastic material. Although not shown, the plurality of micro-perforated plates 102 and/or absorbent layers 104 may alternatively have a sinusoidal-shape instead of being planar. A grid structure may also be provided between adjacent micro-perforated plates of the plurality of micro-perforated plates 102 such that the grid structure defines a plurality of cells configured to hold sections of the plurality of absorbent layers 104. The grid structure may be beneficial in embodiments where the absorbent layers 104 are formed of a relatively loose material that may shift so as to result in an uneven distribution. In FIG. 1, the plurality of absorbent layers 104 are shown as being directly sandwiched between the plurality of micro-perforated plates 102. However, it should be understood that the present disclosure is not limited thereto, and other arrangements are possible as discussed herein. The configuration of the acoustic metamaterial composite 100 renders it a relatively effective structure for controlling noise 106. For instance, a sound absorption coefficient of the acoustic metamaterial composite 100 may range from 0.1 to 1 at a frequency between 10 to 20,000 Hz. A sound transmission loss of the acoustic metamaterial composite 100 may range from 5 to 100 dB at a frequency between 10 to 20,000 Hz.

Figure 2:
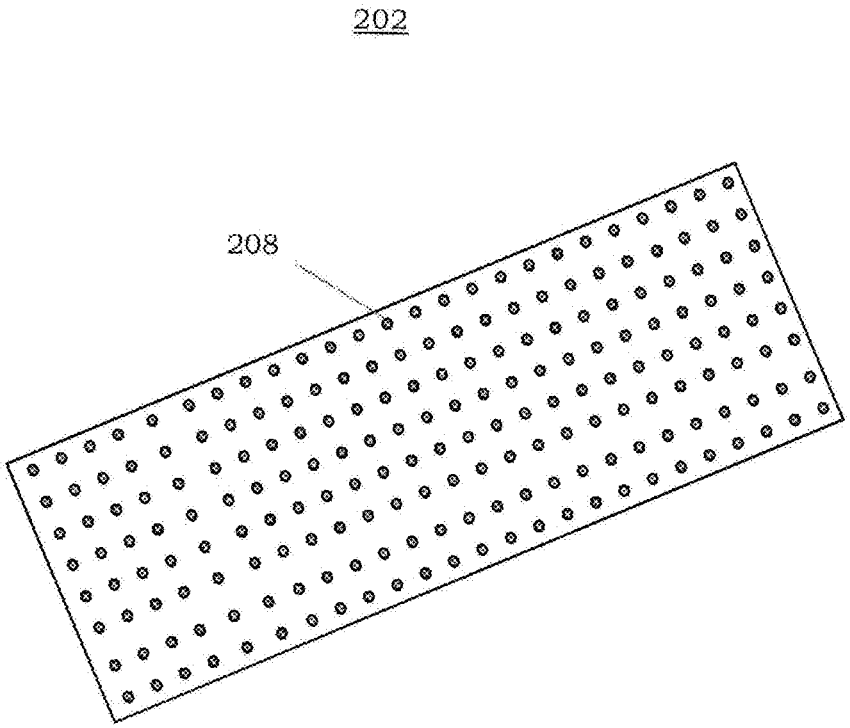
FIG. 2 is a plan view of a micro-perforated plate that is included in an acoustic metamaterial composite according to an example embodiment.

FIG. 2 is a plan view of a micro-perforated plate that is included in an acoustic metamaterial composite according to an example embodiment. Referring to FIG. 2, micro-perforated plate 202 includes a plurality of perforations 208 extending therethrough. Although the micro-perforated plate 202 is shown as having a rectangular shape, it should be understood that other shapes are possible depending on the intended use and/or placement of the acoustic metamaterial composite. The diameter of the perforations 208 may range from 0.1 to 0.3 mm. The spacing between the perforations 208 may range from 0.2 to 0.4 mm. Although the perforations 208 are shown as having a circular shape, it should be understood that the perforations 208 may have other shapes, such as an elliptical shape. The percentage of open area (POA) of the micro-perforated plate 202 may range from 0.2% to 0.7%. In an example embodiment, the micro-perforated plate 202 may include at least 10 perforations 208 per square mm.

Figure 3:
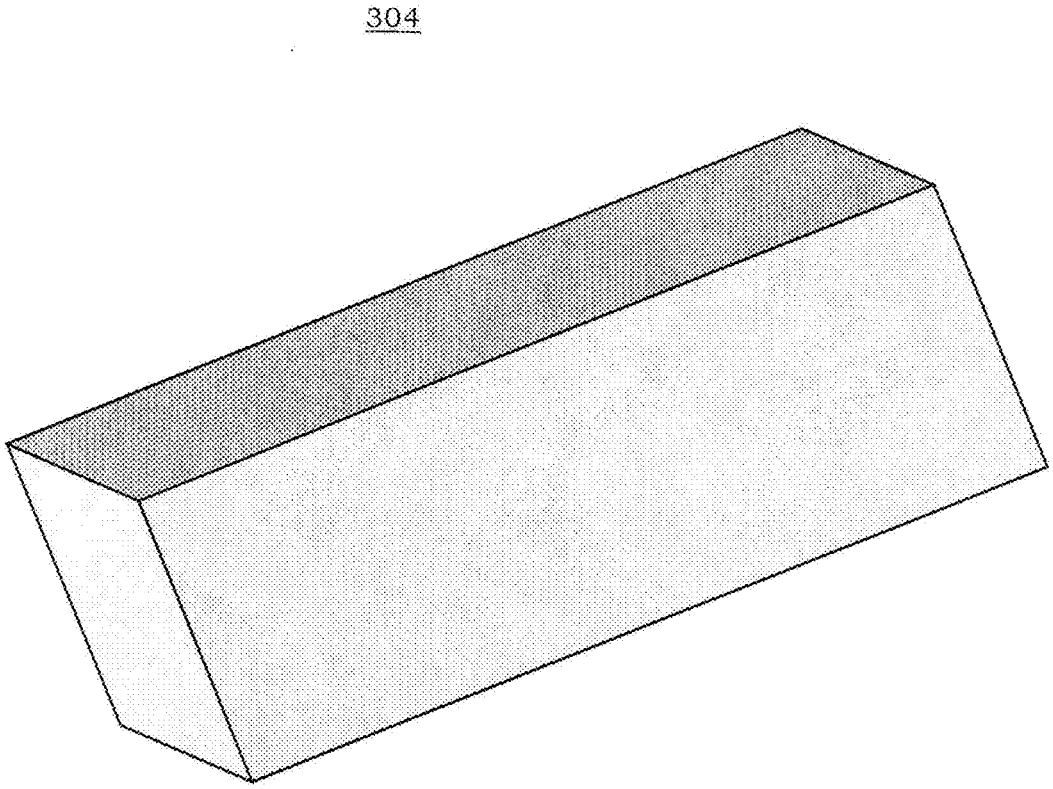
FIG. 3 is a perspective view of an absorbent layer that is included in an acoustic metamaterial composite according to an example embodiment.

FIG. 3 is a perspective view of an absorbent layer that is included in an acoustic metamaterial composite according to an example embodiment. Referring to FIG. 3, the absorbent layer 304 may have a porosity that ranges from 0.8 to 0.99%. The absorbent layer 304 is formed of a poroelastic material. A plurality of spheres (e.g., hollow spheres, solid spheres) may also be embedded within the absorbent layer 304. In an acoustic metamaterial composite, each of the plurality of micro-perforated plates (e.g., micro-perforated plate 202) has a first thickness, and each of the plurality of absorbent layers (e.g., absorbent layer 304) has a second thickness, wherein a ratio of the first thickness to the second thickness ranges from 1:1 to 1:10,000. Stated differently, the ratio of the first thickness of each of the plurality of micro-perforated plates to the second thickness of each of the plurality of absorbent layers may range from 1 to 0.00001.

Figure 4:
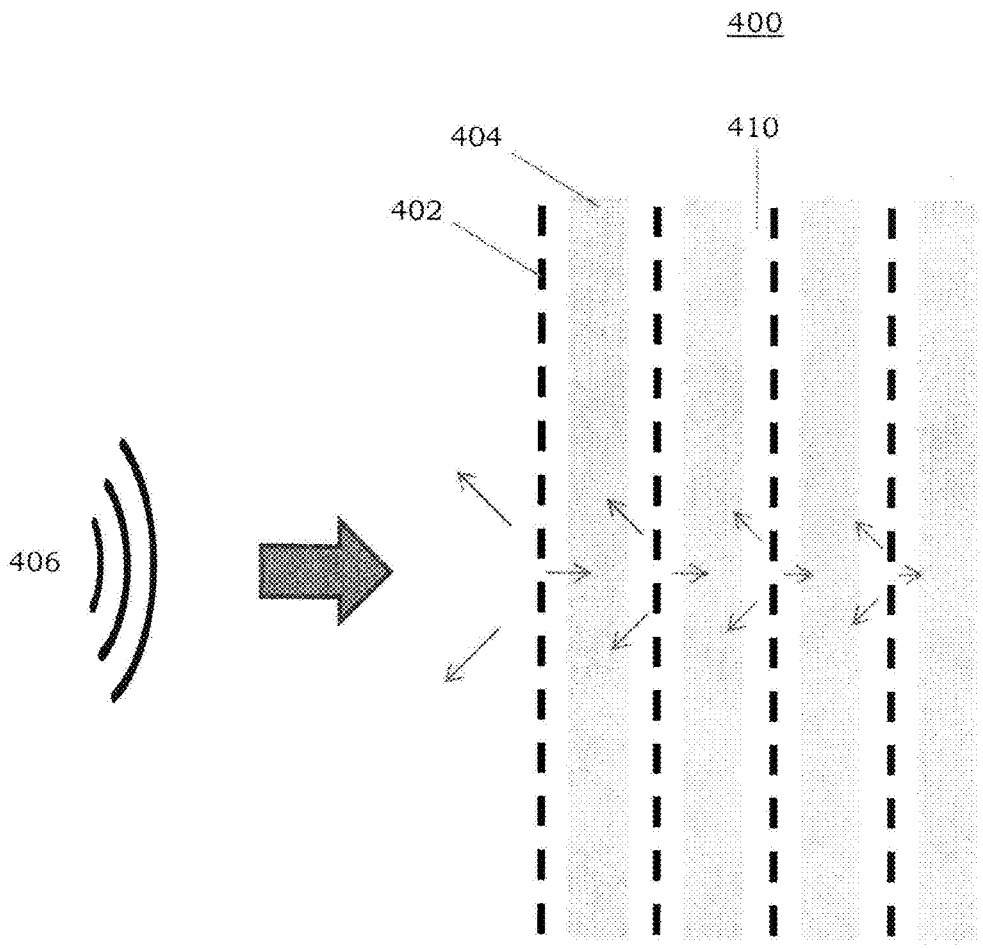
FIG. 4 is a schematic view of an acoustic metamaterial composite with air layers between the micro-perforated plates and absorbent layers according to an example embodiment.

FIG. 4 is a schematic view of an acoustic metamaterial composite with air layers between the micro-perforated plates and absorbent layers according to an example embodiment. Referring to FIG. 4, the acoustic metamaterial composite 400 includes a plurality of micro-perforated plates 402 alternately arranged with a plurality of absorbent layers 404. Each of the plurality of micro-perforated plates 402 and an adjacent one of the plurality of absorbent layers 404 defines an air layer 410 therebetween. A thickness of the air layer 410 may range from 0.1 to 0.3 mm.

When a noise 406 encounters the acoustic metamaterial composite 400, a portion of the sound waves is reflected by an outer one of the micro-perforated plates 402, while a remainder of the sound waves passes through and is absorbed by an adjacent one of the absorbent layers 404. Any remnants of the sound waves that manage to penetrate therethrough are additionally reflected by a subsequent one of the micro-perforated plates 402 and so forth. For instance, each of the plurality of micro-perforated plates 402 may reflect about 20-30% of the sound waves incident thereon while a remainder of the sound waves passes therethrough and is absorbed by an adjacent one of the plurality of absorbent layers 404. As a result of the reflection, transmission, and absorption cycles provided by the alternating arrangement of the micro-perforated plates 402 and absorbent layers 404, the noise 406 can be effectively controlled.

Figure 5:
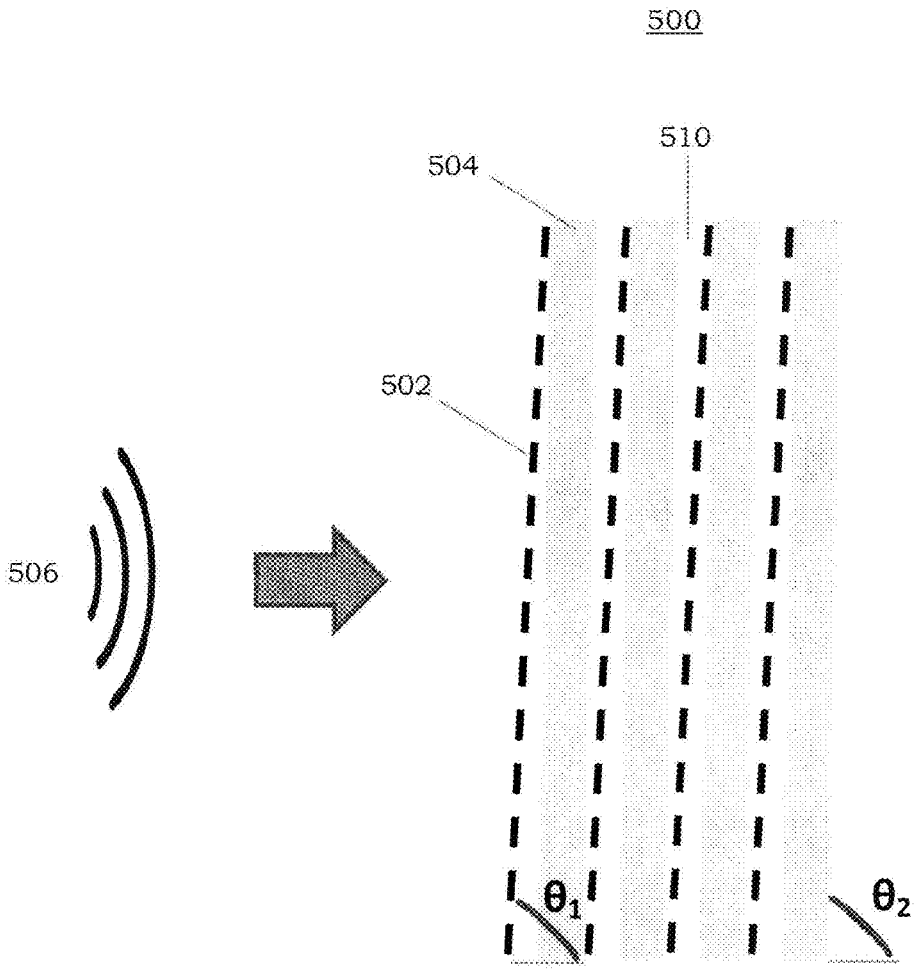
FIG. 5 is a schematic view of an acoustic metamaterial composite with angled micro-perforated plates and absorbent layers according to an example embodiment.

FIG. 5 is a schematic view of an acoustic metamaterial composite with angled micro-perforated plates and absorbent layers according to an example embodiment. Referring to FIG. 5, the acoustic metamaterial composite 500 includes a plurality of micro-perforated plates 502 alternately arranged with a plurality of absorbent layers 504. Each of the plurality of micro-perforated plates 502 and an adjacent one of the plurality of absorbent layers 504 defines an air layer 510 therebetween. The plurality of micro-perforated plates 502 are angled at a first angle $\theta_1$, while the plurality of absorbent layers 504 are angled at a second angle $\theta_2$. Although FIG. 5 shows the first angle $\theta_1$ and the second angle $\theta_2$ as being less than 90 degrees relative to horizontal, it should be understood that example embodiments are not limited thereto with regard to controlling noise 506.

Figure 6:
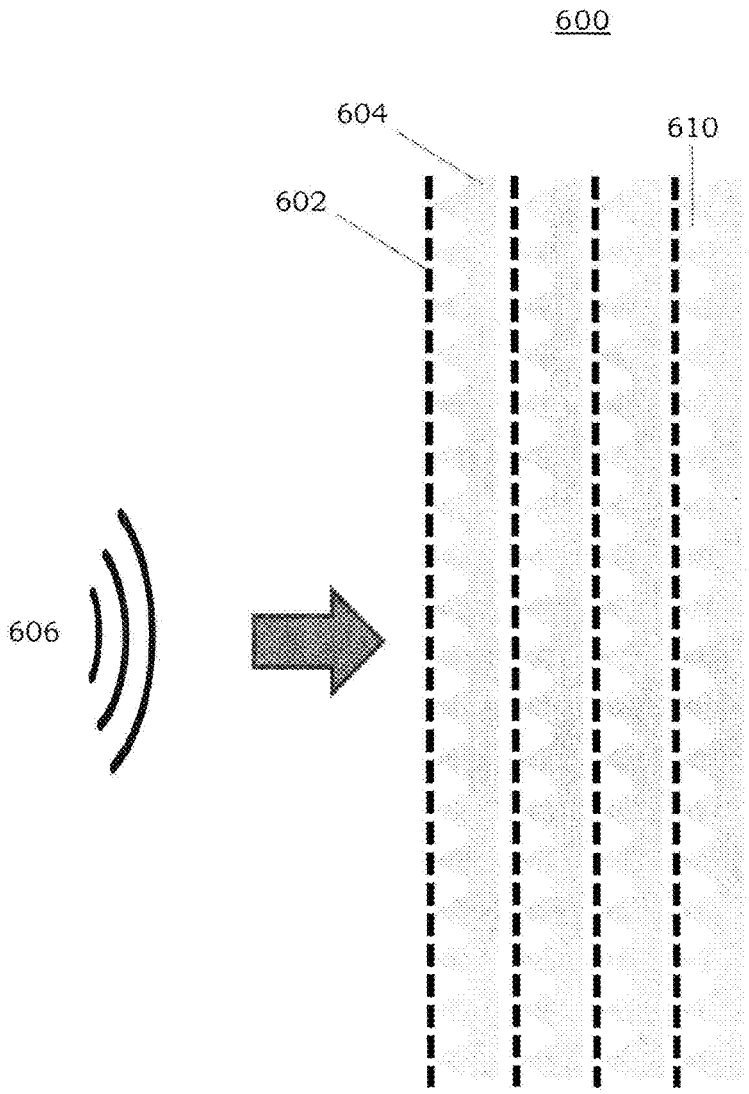
FIG. 6 is a schematic view of an acoustic metamaterial composite with grooved absorbent layers according to an example embodiment.

FIG. 6 is a schematic view of an acoustic metamaterial composite with grooved absorbent layers according to an example embodiment. Referring to FIG. 6, the acoustic metamaterial composite 600 includes a plurality of micro-perforated plates 602 alternately arranged with a plurality of absorbent layers 604. Each of the plurality of micro-perforated plates 602 and an adjacent one of the plurality of absorbent layers 604 defines an air layer 610 therebetween. Each of the plurality of absorbent layers 604 includes a first surface and an opposing second surface. The first surface is grooved so as to have an alternating arrangement of ridges and furrows, while the second surface is planar, although example embodiments are not limited thereto.

Figure 7:
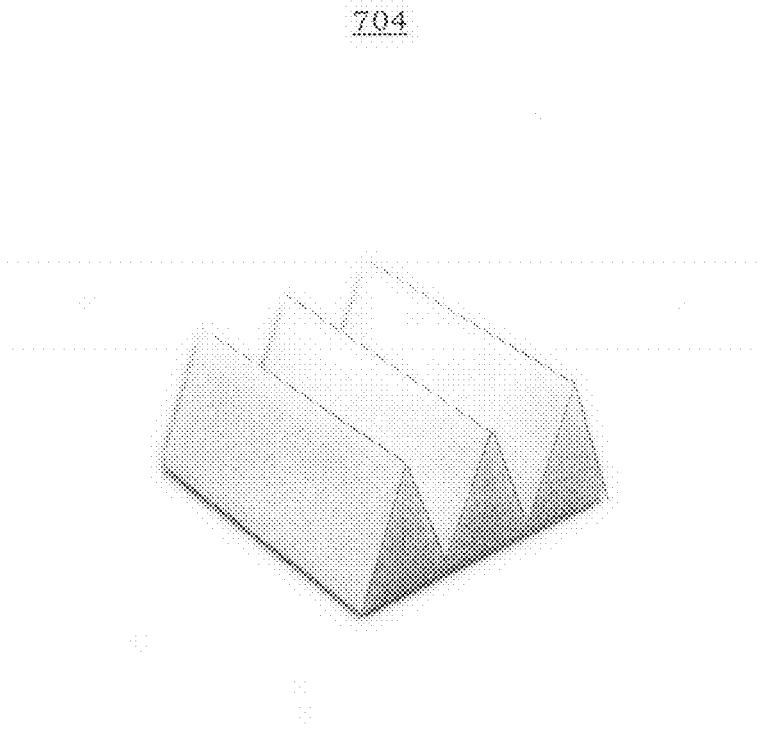
FIG. 7 is a partial view of a grooved absorbent layer that is included in an acoustic metamaterial composite according to an example embodiment.

FIG. 7 is a partial view of a grooved absorbent layer that is included in an acoustic metamaterial composite according to an example embodiment. Referring the FIG. 7, the absorbent layer 704 has a grooved surface that resembles a saw tooth. However, it should be understood that the ridges and/or furrows of the grooved surface may be flattened to soften the peaks and valleys. The absorbent layer 704 may be included in the acoustic metamaterial 600.

Figure 8:
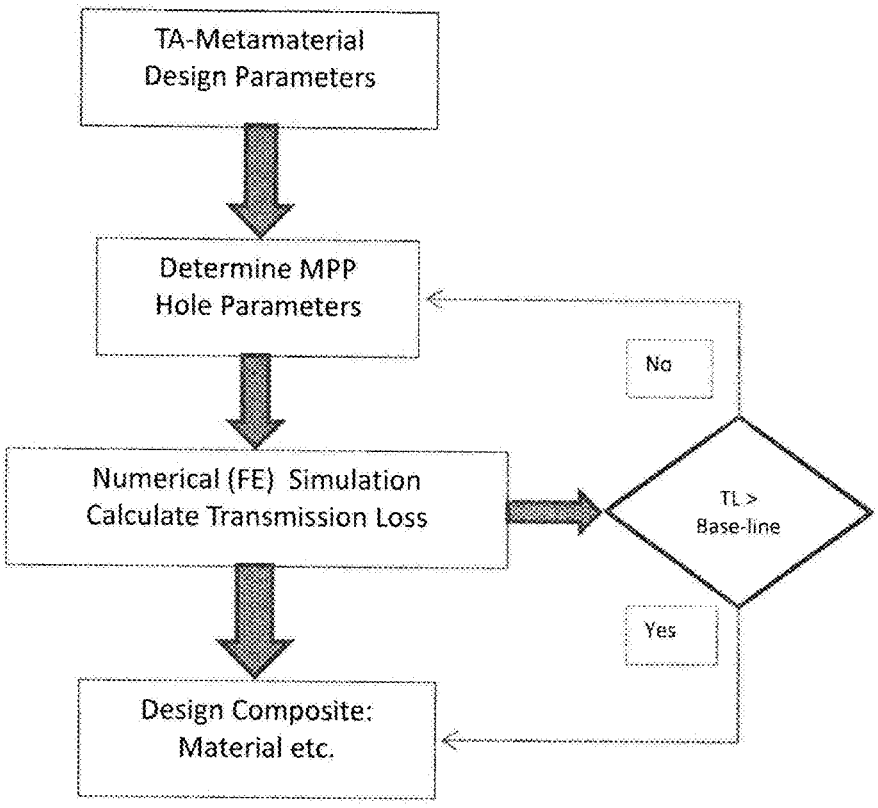
FIG. 8 is a flow diagram of a method of designing an acoustic metamaterial composite according to an example embodiment.

FIG. 8 is a flow diagram of a method of designing an acoustic metamaterial composite according to an example embodiment. Referring to FIG. 8, the design process is reiterated until the transmission loss (TL) of the parameter exceeds the base line.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. An acoustic metamaterial composite, comprising:

A plurality of micro-perforated plates with perforations extending therethrough, the plurality of micro-perforated plates being in a form of a periodically arranged stack; and A plurality of absorbent layers alternately arranged with the plurality of micro-perforated plates, each of the plurality of absorbent layers being a poroeslatic material, a percentage of open area (POA) of each of the plurality of micro-perforated plates and a thickness of each of the plurality of absorbent layers determined using at least the following Equations 1 and 2, $$\bar{\rho}^{\gamma} = \frac{\det(J)(J^{-1})^{T}}{J}\bar{\rho}^{\nu} \quad \text{Equation 1}$$

$$\bar{\kappa}^{\gamma} = \det(J)\bar{\kappa}^{\nu} \quad \text{Equation 2}$$

wherein $\rho^{-\gamma}$ is a fluid density in a real domain, $\rho^{-\nu}$ is a fluid density in a virtual domain, $\kappa^{-\gamma}$ is a fluid bulk modulus in a real domain, $\kappa^{-\nu}$ is a fluid bulk modulus in a virtual domain, and J is a Jacobian transformation.

2. The acoustic metamaterial composite of claim 1, wherein a diameter of the perforations ranges from 0.1 to 0.3 mm.

3. The acoustic metamaterial composite of claim 1, wherein a spacing between the perforations ranges from 0.2 to 0.4 mm.

4. The acoustic metamaterial composite of claim 1, wherein the perforations have an elliptical shape.

5. The acoustic metamaterial composite of claim 1, wherein the percentage of open area (POA) of each of the plurality of micro-perforated plates ranges from 0.2% to 0.7%.

6. The acoustic metamaterial composite of claim 1, wherein each of the plurality of micro-perforated plates includes at least 10 perforations per square mm.

7. The acoustic metamaterial composite of claim 1, wherein the plurality of micro-perforated plates have a sinusoidal-shape.

8. The acoustic metamaterial composite of claim 1, wherein each of the plurality of micro-perforated plates has a first thickness, each of the plurality of absorbent layers has a second thickness, and a ratio of the first thickness to the second thickness ranges from 1 to 0.00001.

9. The acoustic metamaterial composite of claim 1, wherein a porosity of each of the plurality of absorbent layers ranges from 0.8 to 0.99%.

10. The acoustic metamaterial composite of claim 1, wherein each of the plurality of absorbent layers includes a first surface and an opposing second surface, the first surface being grooved so as to have an alternating arrangement of ridges and furrows.

11. The acoustic metamaterial composite of claim 1, wherein each of the plurality of micro-perforated plates and an adjacent one of the plurality of absorbent layers defines an air layer therebetween.

12. The acoustic metamaterial composite of claim 11, wherein a thickness of the air layer ranges from 0.1 to 0.3 mm.

13. The acoustic metamaterial composite of claim 1, further comprising:

a grid structure between adjacent micro-perforated plates of the plurality of micro-perforated plates, the grid structure defining a plurality of cells configured to hold sections of the plurality of absorbent layers.

14. The acoustic metamaterial composite of claim 1, further comprising:

a plurality of spheres embedded within at least one of the plurality of absorbent layers.

15. The acoustic metamaterial composite of claim 1, wherein a sound absorption coefficient of the acoustic metamaterial composite ranges from 0.1 to 1 at a frequency between 10 to 20,000 Hz.

16. The acoustic metamaterial composite of claim 1, wherein a sound transmission loss of the acoustic metamaterial composite ranges from 5 to 100 dB at a frequency between 10 to 20,000 Hz.

17. The acoustic metamaterial composite of claim 1, wherein each of the plurality of micro-perforated plates reflects about 20-30% of sound waves incident thereon while a remainder of the sound waves passes therethrough and is absorbed by an adjacent one of the plurality of absorbent layers.

18. A method of manufacturing an acoustic metamaterial composite, comprising:

forming a plurality of micro-perforated plates and a plurality of absorbent layers alternately arranged with the plurality of micro-perforated plates, a percentage of open area (POA) of each of the plurality of micro-perforated plates and a thickness of each of the plurality of absorbent layers determined using at least the following Equations 1 and 2, $$\bar{\rho}^{\gamma} = \frac{\det(J)(J^{-1})^{T}}{J}\bar{\rho}^{\nu} \qquad \text{Equation 1}$$

$$\bar{\kappa}^{\gamma} = \det(J)\bar{\kappa}^{\nu} \qquad \text{Equation 2}$$

wherein $\rho^{-r}$ is a fluid density in a real domain, $\rho^{-\nu}$ is a fluid density in a virtual domain, $\kappa^{-r}$ is a fluid bulk modulus in a real domain, $\kappa^{-\nu}$ is a fluid bulk modulus in a virtual domain, and J is a Jacobian transformation.

* * * * *